US007651324B2

(12) United States Patent
Yamamoto et al.

(10) Patent No.: US 7,651,324 B2
(45) Date of Patent: Jan. 26, 2010

(54) DIAPHRAGM PUMP

(75) Inventors: Shinya Yamamoto, Kariya (JP); Makoto Yoshikawa, Kariya (JP); Takao Mishina, Kariya (JP); Mamoru Kuwahara, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 312 days.

(21) Appl. No.: 11/141,907

(22) Filed: May 31, 2005

(65) Prior Publication Data

US 2005/0265861 A1 Dec. 1, 2005

(30) Foreign Application Priority Data

Jun. 1, 2004 (JP) ..... 2004-163518

(51) Int. Cl.
*F04B 45/04* (2006.01)
*F01B 19/02* (2006.01)
*F16J 3/02* (2006.01)

(52) U.S. Cl. ..... 417/413.1; 92/100

(58) Field of Classification Search ..... 417/395, 417/413.1; 92/98 R, 100, 199, 99
See application file for complete search history.

(56) References Cited

U.S. PATENT DOCUMENTS 2,511,435 A * 6/1950 Griswold ..... 137/510
3,635,292 A * 1/1972 Last ..... 173/132
3,668,978 A * 6/1972 Bowen ..... 92/98 R
4,262,697 A * 4/1981 Davis ..... 137/625.5
4,508,118 A * 4/1985 Toth ..... 128/204.26
4,993,925 A 2/1991 Becker et al. ..... 417/413
5,554,014 A * 9/1996 Becker ..... 417/413.1
6,019,135 A 2/2000 Onishi ..... 138/30
6,042,345 A * 3/2000 Bishop et al. ..... 417/322
6,435,844 B1 * 8/2002 Fukami ..... 417/395
2003/0039563 A1 * 2/2003 Arbuckle ..... 417/413.1
2004/0131472 A1 7/2004 Yamamoto et al. ..... 417/199.1

FOREIGN PATENT DOCUMENTS

GB 1 197 226 7/1970
GB 2 126 665 3/1984
JP 52-143592 4/1977
JP 7-14179 3/1995

* cited by examiner

*Primary Examiner*—Devon C Kramer
*Assistant Examiner*—Philip Stimpert
(74) *Attorney, Agent, or Firm*—Locke Lord Bissell & Liddell LLP

(57) ABSTRACT

A diaphragm pump for pumping a fluid includes a diaphragm and a driver. The diaphragm has a first surface and a second surface. The driver includes a support portion and is connected to the diaphragm via the support portion. The driver is reciprocated to deform the diaphragm thereby performing a pumping action. The support portion includes a first supporting surface for supporting the first surface and a second supporting surface for supporting the second surface. The support portion allows the diaphragm to slidingly move along an interval between the first and second supporting surfaces when the diaphragm is deformed.

15 Claims, 5 Drawing Sheets

13a
18
17
22
26
21
25
15
14d
49
48a
47c
56
55
47
14b
56b
11c
61
61a
60
62
14
55b
56a
55a
50a
50
58
47a
46
14c
48
11b
12a
14a
45
24
L
10
11
13
12
R
T
S
47c
56a
14b
48a
50a
50
55a
46
55
55b
47a
58
14c
62
11a
14a
12a
61a
12

DIAPHRAGM PUMP

BACKGROUND OF THE INVENTION

The present invention relates to a diaphragm pump that performs a pumping action by deforming a diaphragm thereof.

Unexamined Japanese Utility Model Application Publication No. 7-14179 discloses a typical diaphragm pump. As shown in FIG. 5 that shows this conventional diaphragm pump, it includes a diaphragm case 91, a diaphragm 92 and a driver 93. The diaphragm case 91 includes a block 94 and a tension plate 98 fixed to the block 94. The outer peripheral portion 92*a* of the diaphragm 92 is held between the block 94 and the tension plate 98. A pump chamber 95 is defined by the diaphragm 92 and the block 94.

The driver 93 includes a rod 96 that is reciprocated by the operation of a drive source (not shown) such as an electric motor and a support portion 97 that connects the rod 96 to the center portion of the diaphragm 92. The support portion 97 includes a first support member 97*a* that is located on the surface of the diaphragm 92 on one side thereof, or upper surface as seen in FIG. 5, so as to face a part of the upper surface of the diaphragm 92 and a second support member 97*b* that is located on the surface of the diaphragm on the other side hereof, or lower surface in FIG. 5, so as to face a part of the lower surface of the diaphragm 92. The diaphragm 92 is held at its center portion by the support portion 97 between the first and second support members 97*a*, 97*b*.

The diaphragm 92 is deformed or displaced in accordance with the reciprocation of the rod 96, thereby increasing and decreasing the volume of the pump chamber 95. During the suction stroke of the diaphragm 92, the volume of the pump chamber 95 is increased and a fluid is drawn into the pump chamber 95. During the discharge stroke, the volume of the pump chamber 95 is decreased and the fluid is discharged out of the pump chamber 95.

Meanwhile, in the above conventional diaphragm pumps, the diaphragm 92 is held at the outer peripheral portion 92*a* thereof by the diaphragm case 91 and at the center portion thereof by the support portion 97 of the driver 93. Thus, stress caused by this holding or compression is constantly applied to portions (held portions) of the diaphragm 92 that are held by the diaphragm case 91 and the support portion 97. Additionally, an excessive stress is concentrated to the above held portions of the diaphragm 92 and the boundary between the held portions and the non-held portion of the diaphragm 92 due to the tensile force caused by the deformation of the diaphragm 92. Since excessive load is applied to the diaphragm 92 as described above, the lifetime of the diaphragm 92 is shortened.

In addition to the above-described diaphragm pump in which the diaphragm is deformed directly by the driver as shown in FIG. 5, a diaphragm pump of the type in which a back pressure chamber is formed on the side of a diaphragm opposite to a pump chamber and the diaphragm is deformed by varying the pressure in the back pressure chamber is known. In such diaphragm pump, the outer peripheral portion of the diaphragm is held by the diaphragm case, so that the same problem as that described above has occurred.

The present invention is directed to a diaphragm pump that improves the lifetime of a diaphragm thereof.

SUMMARY OF THE INVENTION

The present invention provides the following first feature. A diaphragm pump for pumping a fluid includes a diaphragm and a driver. The diaphragm has a first surface and a second surface. The driver includes a support portion and is connected to the diaphragm via the support portion. The driver is reciprocated to deform the diaphragm thereby performing a pumping action. The support portion includes a first supporting surface for supporting the first surface and a second supporting surface for supporting the second surface. The support portion allows the diaphragm to slidingly move along an interval between the first and second supporting surfaces when the diaphragm is deformed.

The present invention provides the following second feature. A diaphragm pump for pumping a fluid that includes a diaphragm case and a diaphragm. The diaphragm case includes a support portion. The diaphragm has an outer peripheral portion, a first surface and a second surface. The diaphragm is supported at the outer peripheral portion thereof by the support portion. The diaphragm is deformed thereby performing a pumping action. The support portion includes a first supporting surface for supporting the first surface and a second supporting surface for supporting the second surface. The support portion allows the diaphragm to slidingly move along an interval between the first and second supporting surfaces when the diaphragm is deformed.

The present invention provides the following third feature. A diaphragm pump includes a diaphragm, a driver and a diaphragm case. The diaphragm has an outer peripheral portion. The driver includes a support portion for supporting the diaphragm. The driver is connected to the diaphragm via the support portion thereof. The driver is reciprocated to deform the diaphragm thereby performing a pumping action. The support portion of the driver allows a sliding movement of the diaphragm when the diaphragm is deformed. The diaphragm case includes a support portion for supporting the diaphragm at the outer peripheral portion thereof. The support portion of diaphragm case allows a sliding movement of the diaphragm therein when the diaphragm is deformed.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
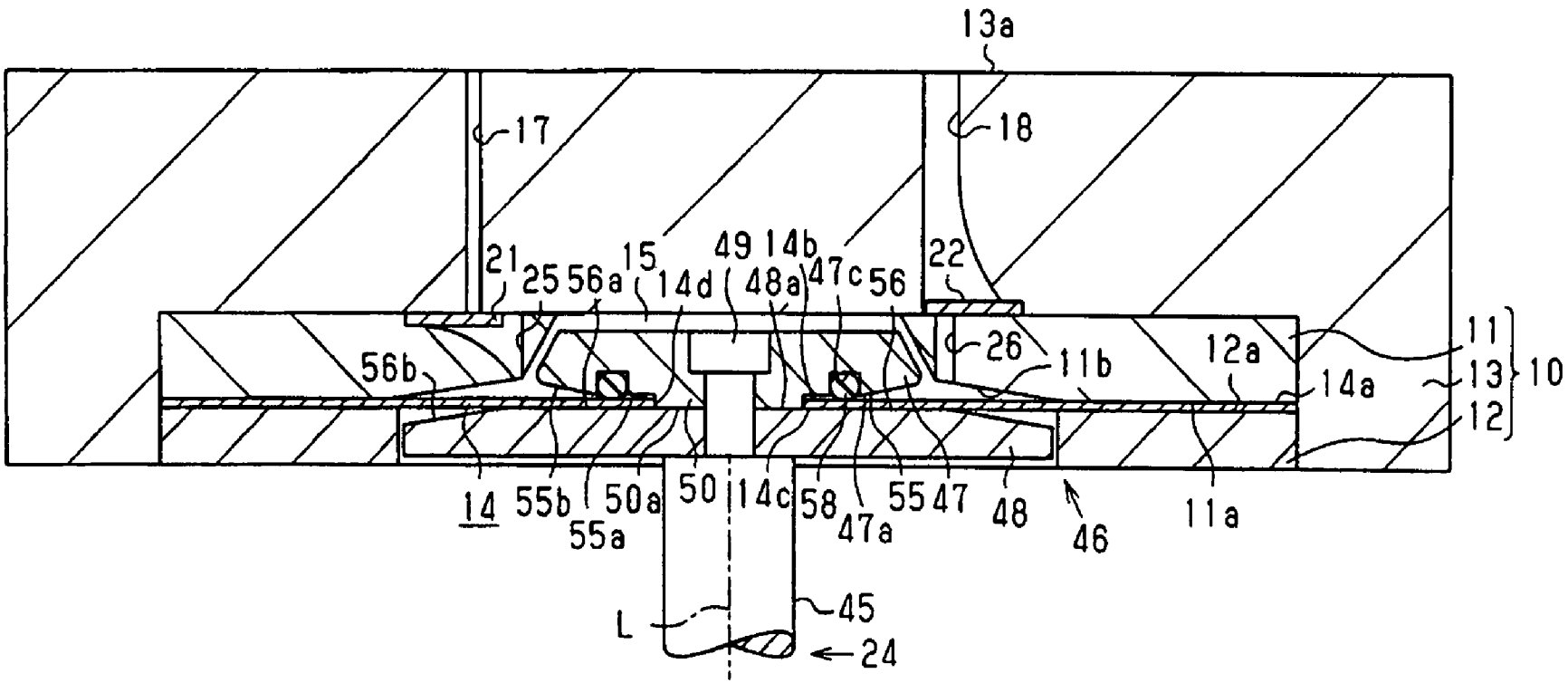
FIG. 1 is a cross-sectional view of a diaphragm pump of a first preferred embodiment according to the present invention.

A first preferred embodiment will be described. Firstly, the structure of a diaphragm pump (referred to merely as "pump" hereinafter) will be described. Referring to FIG. 1 that shows a cross-sectional view of the pump, the pump includes a diaphragm case 10, a diaphragm 14 supported by the diaphragm case 10, and a driver 24 connected to the diaphragm 14.

The driver 24 is reciprocated thereby to deform or displace the diaphragm 14, so that the pump performs a pumping action that causes a fluid (or a gas in the present preferred embodiment) to be drawn into and discharged out of the pump.

The diaphragm case 10 includes a block 11, an annular tension plate 12 that is fixedly joined to the block 11, and a body case 13. The block 11, the tension plate 12 and the diaphragm 14 are accommodated in the body case 13. The body case 13 is formed in a cylindrical shape and has a cover 13*a* located on the top thereof as seen in FIG. 1. The block 11 and the tension plate 12 are arranged in the body case 13 such that the block 11 is located adjacent to the cover 13*a*. The block 11 and the tension plate 12 are fixed to each other and also to the body case 13 by fixing means such as bolt (not shown).

The diaphragm 14 is made of a metal and has a disc shape with a uniform thickness. The diaphragm 14 has a flexibility as is generally known. The diaphragm 14 is fixed to the diaphragm case 10 with annular region of the outer peripheral portion 14*a* held between the block 11 and the tension plate 12. Annular region of a planar supporting surface 11*a* formed on the block 11 is in pressing contact with the outer peripheral portion 14*a* of a first surface 14*b* (or an upper surface as seen in FIG. 1) of the diaphragm 14. Annular region of a planar supporting surface 12*a* formed on the tension plate 12 is in pressing contact with the outer peripheral portion 14*a* of a second surface 14*c* (or a lower surface in FIG. 1) of the diaphragm 14.

The block 11 has a hole 11*b*, which is extending therethrough from the end face thereof adjacent to the tension plate 12 toward the cover 13*a* of the body case 13, at the center portion thereof. The hole 11*b* is opened radially inner than the supporting surface 11*a* of the block 11 at the end face of the block 11 adjacent to the tension plate 12. The hole 11*b* is closed at the opposite openings thereof by the cover 13*a* of the body case 13 and the diaphragm 14, respectively. Thus the internal space of the hole 11*b* being enclosed and defining a pump chamber 15.

The body case 13 of the diaphragm case 10 has a suction passage 17 to which an external low-pressure piping (not shown) is connected, and a discharge passage 18 to which an external high-pressure piping (not shown) is connected. The block 11 has a suction port 25 that connects the pump chamber 15 and the suction passage 17, and a discharge port 26 that connects the pump chamber 15 and the discharge passage 18. A suction valve 21 in the form of a reed valve is provided between the suction port 25 in the block 11 and the suction passage 17 in the body case 13. A discharge valve 22 in the form of a reed valve is provided between the discharge port 26 in the block 11 and the discharge passage 18 in the body case 13.

The driver 24 includes a rod 45 connected to a drive source (not shown) such as an electric motor via a power transmission mechanism (not shown, e.g. a mechanism that converts rotation of the electric motor into reciprocating movement of the rod 45), and a support portion 46 that connects the rod 45 to the center of the diaphragm 14. The rod 45 is reciprocated along the longitudinal axis L thereof (or the vertical direction as seen in FIG. 1) by the operation of the drive source. As the rod 45 is reciprocated, the diaphragm 14 is deformed, or displaced, thereby changing the volume of the pump chamber 15.

The following will describe in detail the manner in which the volume of the pump chamber 15 is changed. When the rod 45 is moved away from the pump chamber 15 (or downward as seen in FIG. 1), the diaphragm 14 is deformed away from the pump chamber 15 and the volume of the pump chamber 15 is increased, accordingly. During this suction stroke, the diaphragm 14 is deformed away from the pump chamber 15 and a gas is drawn through the suction passage 17 into the pump chamber 15 while pushing open the suction valve 21. On the other hand, when the rod 45 is moved toward the pump chamber 15 (or upward as seen in FIG. 1), the diaphragm 14 is deformed toward the pump chamber 15 and the volume of the pump chamber 15 is decreased. During this discharge stroke, the diaphragm 14 is deformed toward the pump chamber 15 and the gas in the pump chamber 15 is discharged through the discharge passage 18 while pushing open the discharge valve 22.

Figure 2A:
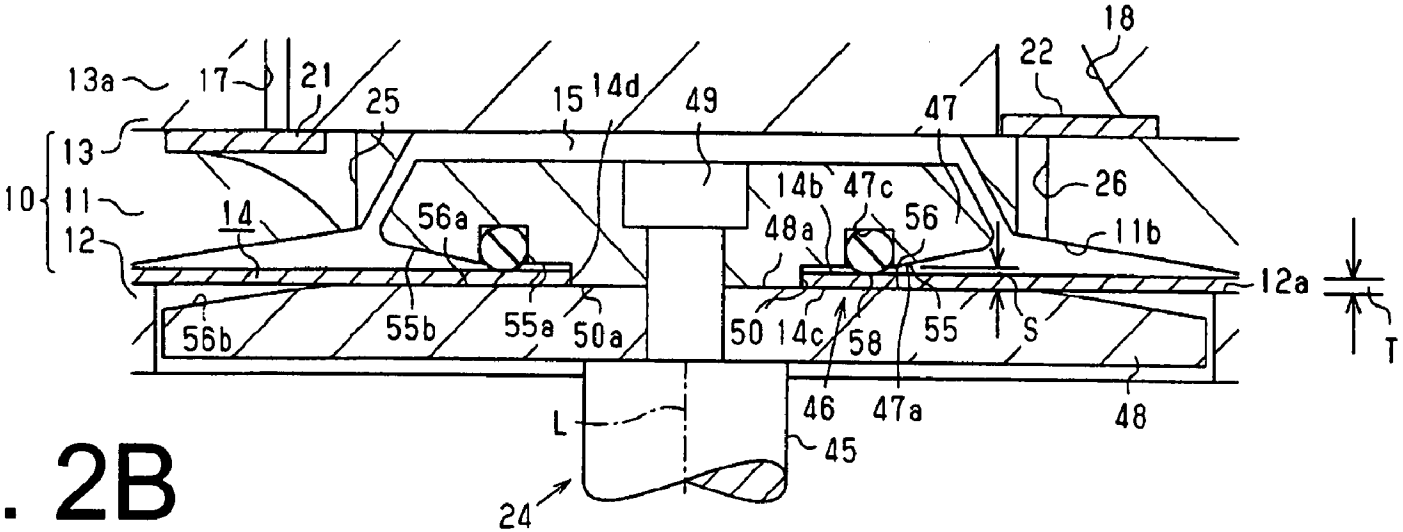
FIG. 2A is a partially enlarged cross-sectional view of the diaphragm pump of FIG. 1.

The following will describe the structure in which the diaphragm 14 and the driver 24 are connected to each other. As shown in FIG. 2A, the diaphragm 14 has a hole 14*d* extending from the first surface 14*b* of the diaphragm 14 to the second surface 14*c*. The support portion 46 of the driver 24 is inserted into the diaphragm 14 through the hole 14*d* of the diaphragm 14. The support portion 46 includes a substantially disc-shaped first support member 47 that is located in the pump chamber 15, or on the side of the first surface 14*b* of the diaphragm 14, and a substantially disc-shaped second support member 48 that is located outside the pump chamber 15, or on the side of the second surface 14*c* of the diaphragm 14. The first and second support members 47, 48 are coaxial with each other. The second support member 48 is coaxially fixed to the end of the rod 45.

The first support member 47 includes a spacer 50 disposed to contact with the second support member 48. The spacer 50 is cylindrical and protrudes toward the second support member 48 from the center portion of the end face 47*a* of the first support member 47 adjacent to the diaphragm 14. The end surface 50*a* of the spacer 50 lies on a plane perpendicular to the axis L. The spacer 50 is inserted into the diaphragm 14 through the hole 14*d*, and the end surface 50*a* thereof is in contact with the center of the end face 48*a* of the second support member 48. Thus, the first support member 47 is directly joined to the second support member 48 through the hole 14*d* of the diaphragm 14. The first support member 47 is fixed to the second support member 48 by a bolt 49 that is inserted through the centers of the first and second support members 47, 48.

The region that excludes the spacer 50 from the end face 47*a* provides a first supporting surface 55. The first supporting surface 55 faces the first surface 14*b* of the diaphragm 14 in the region thereof around the hole 14*d*. The first supporting surface 55 serves to support the first surface 14*b* of the diaphragm 14 during the reciprocating movement of the rod 45 (specifically during the suction stroke of the diaphragm 14). The first supporting surface 55 has an annular planar region 55*a* adjacent to the spacer 50 and an annular inclined region 55*b* which is located adjacent to and radially outer than the annular planar region 55*a*. The planar region 55*a* lies on an imaginary plane that is perpendicular to the axis L of the rod 45. The inclined region 55*b* is inclined with respect to the axis L of the rod 45 so that the outer periphery thereof is the farthest from the imaginary plane on which the planar region 55*a* lies. The provision of the inclined region 55*b* in the first supporting surface 55 prevents application of an excessive bending load to a part of the diaphragm 14, more specifically the boundary between the part of the diaphragm 14 which is supported by the first supporting surface 55 and the part of the diaphragm 14 which is not supported by the first supporting surface 55, when the diaphragm 14 is located at its bottom dead center (or the turning point from the suction stroke to the discharge stroke of the diaphragm 14). Thus, the lifetime of the diaphragm 14 is extended.

The region that excludes a contacting portion contacting to the spacer 50 from the end face 48*a* provides a second supporting surface 56. The second supporting surface 56 faces the second surface 14*c* of the diaphragm 14 around the hole 14*d* and serves to support the second surface 14*c* of the diaphragm 14 during the reciprocating movement of the rod 45 (more specifically during the discharge stroke of the diaphragm 14). The second supporting surface 56 has an annular planar region 56*a* which is adjacent to the contacting portion and an annular inclined region 56*b* which is adjacent to and radially outer than the annular planar region 56*a*. The planar region 56*a* lies on an imaginary plane that is perpendicular to the axis L of the rod 45. The contacting portion also lies on the same imaginary plane. The inclined region 56*b* is inclined with respect to the axis L of the rod 45 so that the outer periphery thereof is the farthest from the imaginary plane on which the planar region 56*a* lies. The provision of the inclined region 56*b* in the second supporting surface 56 prevents application of an excessive bending load to a part of the diaphragm 14, more specifically the boundary between the part of the diaphragm 14 which is supported by the second supporting surface 56 and the part of the diaphragm 14 which is not supported by the second supporting surface 56, when the diaphragm 14 is located at its top dead center (namely, the turning point from the discharge stroke to the suction stroke of the diaphragm 14). Thus, the lifetime of the diaphragm 14 is extended.

The second support member 48 is larger in diameter than the first support member 47. Thus, the radially outer region of the second supporting surface 56 (or most of the annular inclined region 56*b*) is located radially outer than the first supporting surface 55. Even if the diaphragm 14 is removed, the radially outer region of the second supporting surface 56 does not face the first supporting surface 55. In this case, the entire planar region 55*a* of the first supporting surface 55 faces the planar region 56*a* of the second supporting surface 56, but only a part of the planar region 56*a* (or radially inner part) of the second supporting surface 56 face the planar region 55*a* of the first supporting surface 55.

The first support member 47 has an annular groove 47*c* at the boundary between the planar region 55*a* and the inclined region 55*b* in the first supporting surface 55. The annular groove 47*c* is formed to an annular shape with the axis L of the rod 45 as the center thereof. A seal member or an O-ring 58 as a seal means is inserted in the groove 47*c* in sliding contact with the first surface 14*b* of the diaphragm 14. Thus, the O-ring 58 prevents the gas from leaking from the pump chamber 15 through between the first supporting surface 55 of the support portion 46 and the first surface 14*b* of the diaphragm 14, that is, from flowing from the side of the first surface 14*b* of the diaphragm 14 to the side of the second surface 14*c* through between the first and second supporting surfaces 55, 56.

Regarding the position of the O-ring 58 or the position where the gas is prevented from leaking from the pump chamber 15, it is better to provide the O-ring 58 between first supporting surface 55 and the first surface 14*b* of the diaphragm 14 than between the second supporting surface 56 and the second surface 14*c* of the diaphragm 14. Furthermore, it is preferable that the O-ring 58 provided between the first supporting surface 55 and the first surface 14*b* of the diaphragm 14 should be positioned as radially outward in the planner region 55*a* as possible. In the space between the first and second supporting surfaces 55, 56, the region on the side of the pump chamber 15 from the position of the O-ring 58 (or the seal position), that is, on the radially outer side of the O-ring 58, forms a part of the pump chamber 15. This space corresponds to dead volume of the pump chamber 15 (or prevents the minimum volume of the pump chamber 15 from being zero) when the diaphragm 14 is located at its top dead center. If the dead volume of the pump chamber 15 is larger, the amount of residual gas that is not discharged from the pump chamber 15 and that remains in the pump chamber 15 is larger. Therefore, the residual gas may reexpand in the pump chamber 15, with the result that the efficiency of the pump deteriorates. If the O-ring 58 is positioned as radially outward in the planner region 55*a* as possible between the first supporting surface 55 and the first surface 14*b* of the diaphragm 14, the dead volume of the pump chamber 15 is smaller, thus further improving the efficiency of the pump. In this view, it is more effective to position the O-ring 58 at the boundary between the planar region 55*a* and the inclined region 55*b* of the first supporting surface 55 as in the present preferred embodiment or on the inclined region 55*b* than on the planar region 55*a* (considered as an alternative embodiment of the present preferred embodiment) or between second supporting surface 56 and the second surface 14*c* of the diaphragm 14 (considered as an alternative embodiment of the present preferred embodiment).

The following will describe the setting of the height of the spacer 50 of the first support member 47, namely, the setting of a minimum value S which is the minimum interval between the first supporting surface 55 and the second supporting surface 56. The height of the spacer 50 refers to the distance between the imaginary plane on which the planar region 55*a* of the first supporting surface 55 lies and the imaginary plane on which the end surface 50*a* of the spacer 50 lies.

Pressing the first support member 47 against the second support member 48 at the spacer 50 by tightening the bolt 49, the spaced distance between the first and second supporting surfaces 55, 56 is set at its minimum value S which corresponds to the height of the spacer 50. In this preferred embodiment, the height of the spacer 50, that is, the minimum value S, more specifically the interval between the planar region 55*a* of the first supporting surface 55 and the planar region 56*a* of the second supporting surface 56 is set at or greater than a thickness T of the diaphragm 14 between the first and second supporting surfaces 55, 56. By so setting, the diaphragm 14 is not held strongly between the planar region 55*a* of the first supporting surface 55 and the planar region 56*a* of the second supporting surface 56 even when the bolt 49 is tightened fast.

Figure 2B:
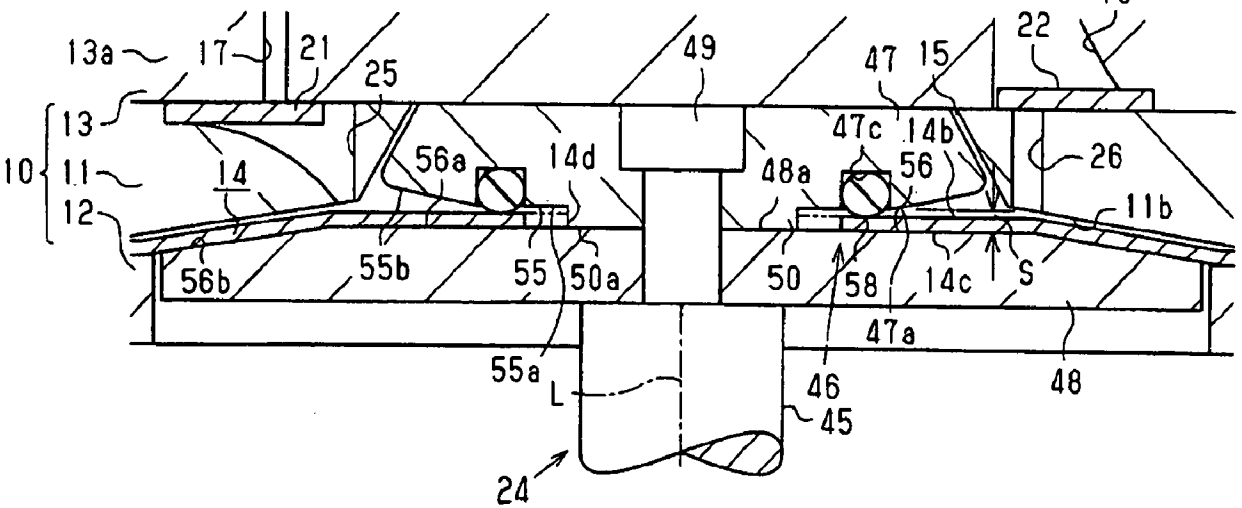
FIG. 2B is a partially enlarged cross-sectional view of the diaphragm pump of the first preferred embodiment when a diaphragm is deformed.

In this preferred embodiment, the minimum value S is set greater than the thickness T of the diaphragm 14. Namely, the minimum value S is so set that a gap defining an empty space is made at least either between the planar region 55*a* of the first supporting surface 55 and the first surface 14*b* of the diaphragm 14 or between the planar region 56*a* of the second supporting surface 56 and the second surface 14*c* of the diaphragm 14. As shown in FIG. 2A and FIG. 2B, the gap that defines the empty space extends along the entire radial surface of at least one of the first and second supporting surfaces.

When the diaphragm 14 is changed from the state shown in FIG. 2A to state that shown in FIG. 2B, that is, when the diaphragm 14 increases the amount of its deformation, tensile force is applied to the diaphragm 14, which is then slidingly moved along the interval between the first and second supporting surfaces 55, 56 away from the axis L of the rod 45, as clearly shown in FIG. 2B. On the other hand, when the diaphragm 14 is changed from the state of FIG. 2B to that of FIG. 2A, that is, when the diaphragm 14 decreases the amount of its deformation, the diaphragm 14 is slidingly moved along the interval between the first and second supporting surfaces 55, 56 toward the axis L of the rod 45).

According to the above-described preferred embodiment, the following advantageous effects are obtained.

(1) Since the diaphragm 14 is not held tight between the first and second supporting surfaces 55, 56, the diaphragm 14 is not applied to a stress which is due to tight holding. When tensile force is applied to the diaphragm 14 to increase the amount of its deformation, the diaphragm 14 is slidingly moved along the interval between the first and second supporting surfaces 55, 56. Thus, application of excessive tensile force to the diaphragm 14 is prevented and, therefore, the lifetime of the diaphragm 14 is extended.

(2) The minimum value S is set at or greater than the thickness T of the diaphragm 14 between the first and second supporting surfaces 55, 56. By so setting, the support portion 46 does not hold the diaphragm 14 tight and allows the sliding movement of the diaphragm 14.

In this preferred embodiment, the minimum value S is set greater than the thickness T of the diaphragm 14 between the first and second supporting surfaces 55, 56. Thus, the support portion 46 does not hold the diaphragm 14 tight and allows smooth sliding movement thereof. Accordingly, the diaphragm 14 is prevented from being subjected to excessive tensile force, and the lifetime of the diaphragm 14 is further extended.

(3) The first support member 47 includes the spacer 50 between the first and second support members 55, 56 for determining the interval between the first and second supporting surfaces 55, 56. Thus, the provision of the spacer 50 prevents the interval (more specifically the minimum value S thereof between the first and second supporting surfaces 55, 56 from becoming smaller than a desired value. By providing the spacer 50, control of the minimum interval (more specifically the minimum value S) between the first and second support members 55, 56 is facilitated in comparison with the case when the support portion does not include the spacer 50. Thus, when the diaphragm 14 is deformed, the diaphragm 14 is slidingly moved smoothly between the first and second supporting surfaces 55, 56, with the result that application of excessive tensile force to the diaphragm 14 is more effectively prevented.

(4) Since the spacer 50 is provided integrally with the first support member 47, the number of component parts of the support portion 46 can be reduced, and the process of assembling the pump can be simplified.

(5) The O-ring 58 is provided between the first supporting surface 55 of the support portion 46 and the first surface 14*b* of the diaphragm 14 for preventing the gas from leaking from the pump chamber 15. Even though the support portion 46 is formed so as to allow the diaphragm 14 to slidingly move between the first and second supporting surfaces 55, 56, the deterioration of the efficiency of the pump is prevented by the provision of such O-ring.

The following will describe a pump of a second preferred embodiment. The differences from the pump of the first preferred embodiment will be described. Like or same elements are referred to by the same reference numerals as those which have been used in describing the pump of the first preferred embodiment, and the description thereof is not reiterated.

Figure 3A:
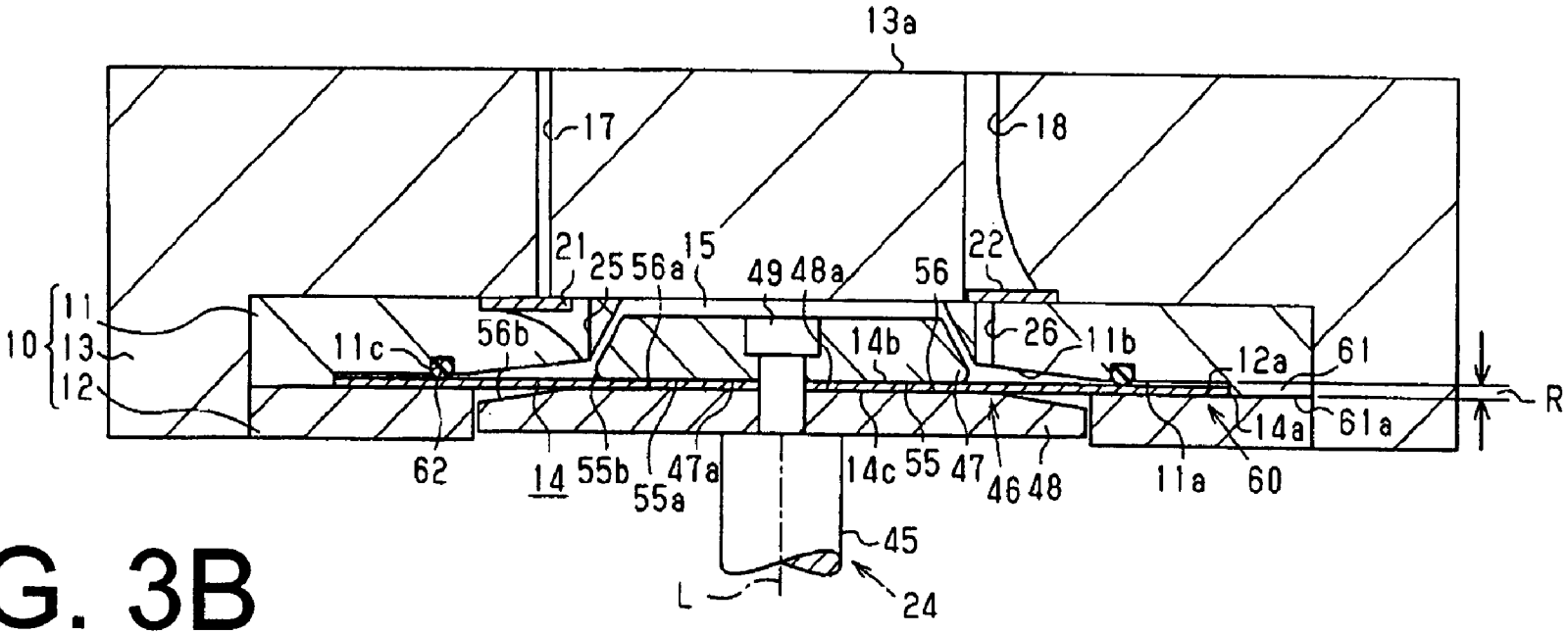
FIG. 3A is a cross-sectional view of a diaphragm pump of a second preferred embodiment according to the present invention.
Figure 3B:
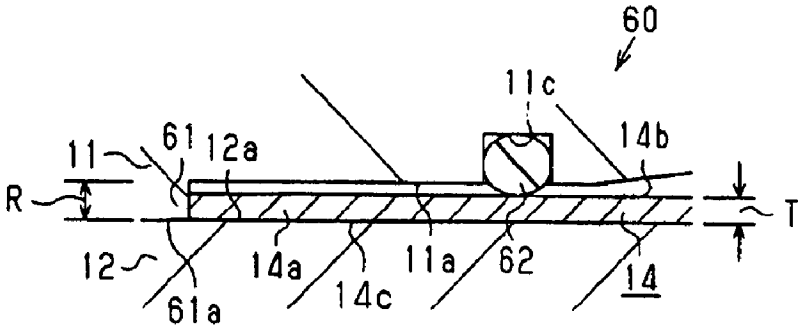
FIG. 3B is a partially enlarged cross-sectional view of the diaphragm pump of FIG. 3A.

As shown in FIGS. 3A and 3B, the pump of the second preferred embodiment differs from the pump of the first preferred embodiment in that the spacer 50 is removed from the first support member 47 and also that the groove 47*c* and the inclined region 55*a* are removed from the first supporting surface 55, and the O-ring 58 is removed from between the first and second support members 47, 48. Thus, the radially inner portion of the diaphragm 14 is held relatively strongly between the planar region 55*a* of the first supporting surface 55 and the planar region 56*a* of the second supporting surface 56. Namely, the support portion 46 of the driver 24 is connected to the diaphragm 14 in the same manner as the conventional pump. The diaphragm case 10 includes a support portion 60 with a structure for allowing the sliding movement of the diaphragm 14.

The support portion 60 of the diaphragm case 10 includes a block or a first support member 11 and a tension plate or a second support member 12. The block 11 has a first supporting surface 11*a*, and the tension plate 12 has a second supporting surface 12*a* which is parallel to the first supporting surface 11*a*. The first and second supporting surfaces 11*a*, 12*a* lie on imaginary planes perpendicular to the axis L of the rod 45, respectively. An annular (peripheral-wall-shaped) spacer 61 is formed integrally with the block 11 on the radially outer side of the first supporting surface 11*a*. The spacer 61 has an end surface 61*a* which lies on an imaginary plane perpendicular to the axis L of the rod 45. The spacer 61 is joined to the tension plate 12 with the end surface 61*a*. The end surface 61*a* is in contact with the surface of the tension plate 12, is located radially outer than the second supporting surface 12*a* and lies in the same plane as the second supporting surface 12*a*.

An annular groove 11*c* with the axis L of the rod 45 as the center thereof is formed in the first supporting surface 11*a*. A seal member or an O-ring 62 as a seal means is inserted in the groove 11*c* in contact with the first surface 14*b* of the diaphragm 14. The groove 11*c* is preferably formed in the first supporting surface 11*a* at a position which is close to the axis L of the rod 45 for reducing the dead volume of the pump chamber 15 thereby to improve the efficiency of the pump. The O-ring 62 prevents the gas from leaking from the pump chamber 15 through between the first supporting surface 11*a* of the support portion 60 and the first surface 14*b* of the diaphragm 14, that is, from flowing from the side of the first surface 14*b* of the diaphragm 14 to the side of the second surface 14*c* through between the first and second supporting surfaces 11*a*, 12*a*.

The height of the spacer 61, namely, a minimum value R which is the minimum interval between the first and second supporting surfaces 11*a*, 12*a* is set at or greater than a thickness T of the diaphragm 14 between the first and second supporting surfaces 11*a*, 12*a*, so that the diaphragm 14 is not held strongly between the first and second supporting surfaces 11*a*, 12*a*. Since the first and second supporting surfaces 11*a*, 12*a* are disposed parallel to each other, the interval between the first and second supporting surfaces 11*a*, 12*a* is considered as the minimum value R throughout the range for the interval. More specifically, the minimum value R is set greater than the thickness T of the diaphragm 14 in this preferred embodiment. Namely, the minimum value R is so set that a gap is made at least either between the first supporting surface 11*a* and the first surface 14*b* of the diaphragm 14 or between the second supporting surface 12*a* and the second surface 14*c* of the diaphragm 14.

When the diaphragm 14 increases the amount of its deformation, the tensile force is applied to the diaphragm 14 and the diaphragm 14 is moved slidingly between the first and second supporting surfaces 11*a*, 12*a* toward the axis L of the rod 45. On the other hand, when the diaphragm 14 decreases the amount of its deformation, the diaphragm 14 is moved back slidingly between the first and second supporting surfaces 11*a*, 12*a* away from the axis L of the rod 45. According to the second preferred embodiment, substantially the same advantageous effects as those in the above-described first preferred embodiment are obtained.

The above-described first and second preferred embodiments are merely examples of the present invention and may be modified without departing from the purpose of the invention. The following alternative embodiments are also practicable. Any combination of the following alternative embodiments is practiced unless the alternative embodiments for the combination are inconsistent with each other.

Figures 4A, 4B, 4C:
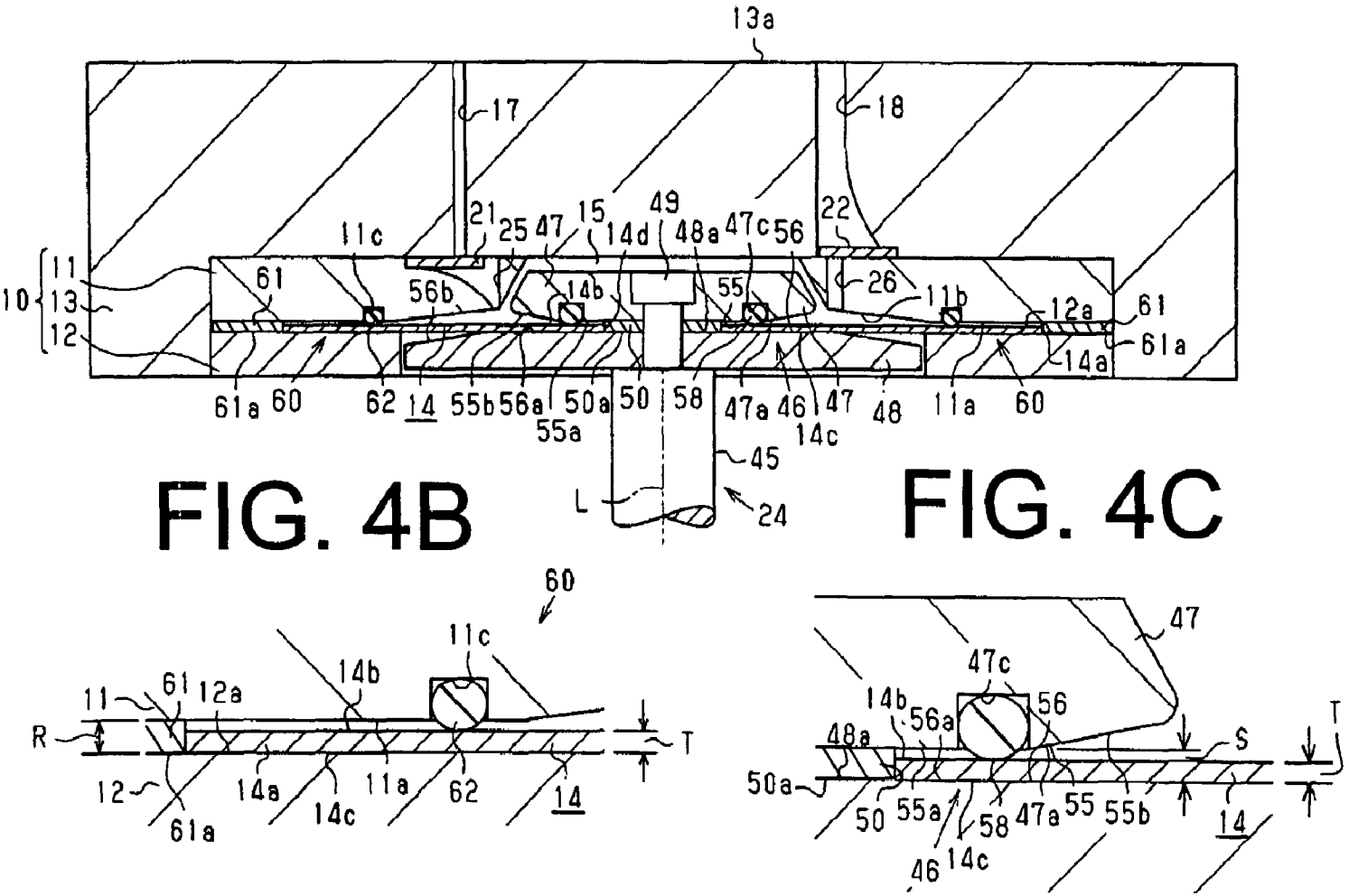
FIG. 4A is a cross-sectional view of a diaphragm pump of an alternative embodiment according to the present invention.
FIG. 4B is a partially enlarged cross-sectional view of the diaphragm pump of FIG. 4A showing a support portion of a diaphragm case.
FIG. 4C is a partially enlarged cross-sectional view of the diaphragm pump of FIG. 4A showing a support portion of a driver.
Figure 5:
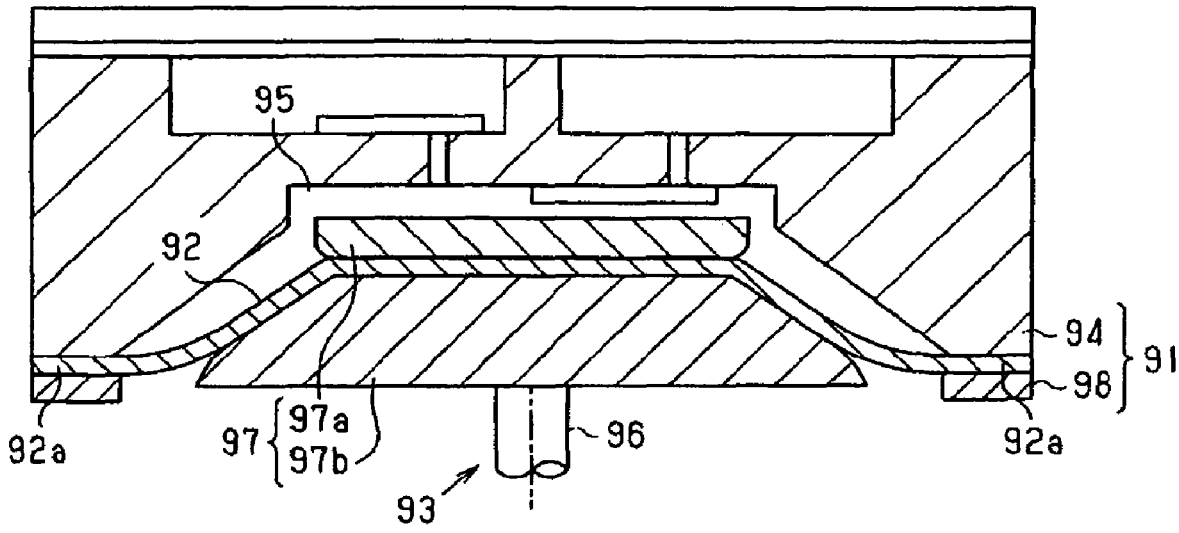
FIG. 5 (PRIOR ART)
FIG. 5 is a cross-sectional view of a diaphragm pump according to prior art.

FIGS. 4A through 4C show an embodiment in which the characterizing features of the first and second preferred embodiments are combined. Namely, the driver 24 includes the support portion 46, and the diaphragm case 10 includes the support portion 60. Thus, the diaphragm 14 is slidingly movable both at the support portion 46 of the driver 24 and at the support portion 60 of the diaphragm case 10 when the diaphragm 14 is deformed. In addition, the spacer 50 is provided separately from the first and second support members 47, 48, and the spacer 61 is provided independently of the block 11 and the tension plate 12 to adjust the gap between the planner region 55*a* and the first surface 14*b* and the between the first supporting surface 11*a* and the first surface 14*b* more exactly.

In the above-described first preferred embodiment, the spacer 50 may be integral with the second support member 48 and in contact with the first support member 47. In the above-described second preferred embodiment, the spacer 61 may be integral with the tension plate 12 and in contact with the block 11.

In the above-described first preferred embodiment, the minimum value S which is the minimum interval between the first and second supporting surfaces 55, 56 may be set slightly smaller (at most 10%) than the thickness T of the diaphragm 14 provided between the first and second supporting surfaces 55, 56. In the above-described second preferred embodiment, the minimum value R which is the minimum interval between the first and second supporting surfaces 11*a*, 12*a* may be set slightly smaller (at most 10%) than the thickness T of the diaphragm 14 provided between the first and second supporting surfaces 11*a*, 12*a*. As long as the diaphragm 14 is allowed to slidingly move between the first and second surfaces 11, 12*a* when it is deformed, the diaphragm 14 may be directly held between the planar region 55*a* of the first supporting surface 55 and the planar region 56*a* of the second supporting surface 56 or between the first and second supporting surfaces 11*a*, 12*a*.

In the above-described first preferred embodiment, the block 11 and the tension plate 12 may be loosely joined to each other, for example, the block 11 and the tension plate 12 are fastened by tightening loosely the bolt (not shown) so as to allow the diaphragm 14 to slidingly move between the supporting surfaces 11*a*, 12*a* when the diaphragm 14 is deformed. In the above-described second preferred embodiment, the bolt 49 is tightened loosely to allow the diaphragm 14 to slidingly move between and along the first and second supporting surfaces 55, 56 when the diaphragm 14 is deformed.

In the above-described first and second preferred embodiments, a seal means (e.g. O-ring) may be provided between the second supporting surface 56 and the second surface 14*c* of the diaphragm 14. A lip seal may be used as the seal means.

The above-described first preferred embodiment may dispense with the O-ring 58. Likewise, the above-described second preferred embodiment may dispense with the O-ring 62.

The present invention is applicable also to a diaphragm pump of the type that it does not has a driver such as the driver 24 of the above-described first and second preferred embodiments, a back pressure chamber is formed on the side of a diaphragm opposite to a pump chamber, and also that the diaphragm is deformed by variation of pressure in the back pressure chamber. The present invention (more specifically the feature of the second preferred embodiment) is also applicable to a diaphragm pump for pumping a liquid.

The present examples and embodiments are to be considered as illustrative and not restrictive, and the invention is not to be limited to the details given herein but may be modified within the scope of the appended claims.

What is claimed is:

1. A diaphragm pump for pumping a fluid, comprising:

a diaphragm having an inner peripheral portion, a first surface and a second surface;

a driver including a support portion, the driver being connected to the inner peripheral portion of the diaphragm via the support portion, the driver being reciprocated to deform the diaphragm thereby performing a pumping action, wherein the support portion includes a first supporting surface for supporting the first surface and a second supporting surface for supporting the second surface, the second supporting surface including a planar region which contacts the second surface by plane contact, wherein the support portion allows the inner peripheral portion of the diaphragm to slidingly move along an interval between the first and second supporting surfaces when the diaphragm is deformed by the reciprocation of the driver;

a pump chamber formed in the diaphragm pump and defined on the side of the first surface of the diaphragm, the pump chamber being changed in volume by deformation of the diaphragm; and an O-ring provided only between the first supporting surface of the support portion and the first surface of the diaphragm, wherein a minimum value of the interval between the first and second supporting surfaces is greater than a thickness of the diaphragm, so that an empty space extending along the entire radial extent of the first or second surface of the diaphragm exists between the first supporting surface and the first surface or between the second supporting surface and the second surface.

2. The diaphragm pump according to claim 1, wherein the support portion includes a first support member having the first supporting surface and a second support member having the second supporting surface, the first and second support members being fixedly joined to each other, the support portion including a spacer between the first and second supporting surfaces for determining the interval between the first and second supporting surfaces.

3. The diaphragm pump according to claim 2, wherein the spacer is formed integral with one of the first and second support members, the spacer being in contact with the other of the first and second support members.

4. The diaphragm pump according to claim 1, wherein a seal means is located near the boundary between the first supporting surface of the support portion and the pump chamber.

5. The diaphragm pump according to claim 1, wherein the second supporting surface includes an inclined region which is adjacent to the planar region.

6. The diaphragm pump according to claim 1, wherein the first supporting surface has a planar region, an inclined region and an annular groove at the boundary between the planar region and the inclined region, wherein the O-ring is inserted in the annular groove in slide contact with the first surface of the diaphragm.

7. The diaphragm pump according to claim 1, wherein the diaphragm has an outer peripheral portion, the pump further comprising a diaphragm case including a support portion for supporting the diaphragm at the outer peripheral portion thereof, the support portion of the diaphragm case allowing a sliding movement of the diaphragm when the diaphragm is deformed.

8. A diaphragm pump for pumping a fluid, comprising:

a diaphragm case including a support portion;

a diaphragm having an inner peripheral portion and an outer peripheral portion, a first surface and a second surface, the diaphragm being supported at the outer peripheral portion thereof by the support portion, the diaphragm being deformed thereby performing a pumping action, wherein the support portion includes a first supporting surface for supporting the first surface and a second supporting surface for supporting the second surface, the second supporting surface including a planar region which contacts the second surface by plane contact;

a driver connected to the inner peripheral potion of the diaphragm, the driver being reciprocated to deform the diaphragm thereby performing a pumping action, wherein the support portion allows the outer peripheral portion of the diaphragm to slidingly move along an interval between the first and second supporting surfaces when the diaphragm is deformed by the reciprocation of the driver;

a pump chamber formed in the diaphragm pump and defined on the side of the first surface of the diaphragm, the pump chamber being changed in volume by the deformation of the diaphragm; and an O-ring provided only between the first supporting surface of the support portion and the first surface of the diaphragm, wherein a minimum value of the interval between the first and second supporting surfaces is greater than a thickness of the diaphragm, so that an empty space extending along the entire radial extent of the first or second surface of the diaphragm exists between the first supporting surface and the first surface or between the second supporting surface and the second surface.

9. The diaphragm pump according to claim 8, wherein the support portion includes a first support member having the first supporting surface and a second support member having the second supporting surface, the first and second support members being fixedly joined to each other, the support portion including a spacer between the first and second supporting surfaces for determining the interval between the first and second supporting surfaces.

10. The diaphragm pump according to claim 9, wherein the spacer is formed integral with one of the first and second support members, the spacer being in contact with the other of the first and second support members.

11. The diaphragm pump according to claim 8, wherein a seal means is located near the boundary between the first supporting surface of the support portion and the pump chamber.

12. The diaphragm pump according to claim 8, further comprising a driver including a support portion for supporting the diaphragm, the support portion of the driver having a planar region and an inclined region on the side which faces the second surface of the diaphragm, the support portion of the driver allowing a sliding movement of the diaphragm at the support portion when the diaphragm is deformed.

13. A diaphragm pump comprising:

a diaphragm having an inner peripheral portion and an outer peripheral portion, the diaphragm having a first surface and a second surface;

a driver including a support portion for supporting the diaphragm at the inner peripheral portion thereof, the driver being connected to the diaphragm via the support portion thereof, the driver being reciprocated to deform the diaphragm thereby performing a pumping action, wherein the support portion of the driver includes a first supporting surface for supporting the first surface and a second supporting surface for supporting the second surface wherein the support portion of the driver allows a sliding movement of the inner peripheral portion of the diaphragm along an interval between the first and second supporting surfaces thereof when the diaphragm is deformed by the reciprocation of the driver;

a diaphragm case including a support portion for supporting the diaphragm at the outer peripheral portion thereof, wherein the support portion of the diaphragm case includes a first supporting surface for supporting the first surface and a second supporting surface for supporting the second surface, wherein the support portion of diaphragm case allows a sliding movement of the outer peripheral portion of the diaphragm along an interval between the first and second supporting surfaces thereof when the diaphragm is deformed by the reciprocation of the driver;

a pump chamber formed in the diaphragm pump, the pump chamber being changed in volume by the deformation of the diaphragm; and an O-ring provided only between the support portion of the driver and the inner peripheral portion of the diaphragm on the pump chamber side and only between the support portion of the diaphragm case and the outer peripheral portion of the diaphragm on the pump chamber side, wherein the side of the diaphragm facing the driver is supported by the driver and the diaphragm case by plane contact, wherein a minimum value of each interval between the first and second supporting surfaces is greater than a thickness of the diaphragm, so that an empty space extending along the entire radial extent of the first or second surface of the diaphragm exists between the first supporting surface and the first surface or between the second supporting surface and the second surface.

14. The diaphragm pump according to claim 8, wherein the first supporting surface has a planar region, an inclined region and an annular groove at the boundary between the planar region and the inclined region, wherein the O-ring is inserted in the annular groove in slide contact with the first surface of the diaphragm.

15. The diaphragm pump according to claim 13, wherein each first supporting surface of the support portions has a planar region, an inclined region and an annular groove at the boundary between the planar region and the inclined region, wherein the O-ring is inserted in the annular groove in slide contact with the first surface of the diaphragm.

* * * * *